US010544510B2

(12) United States Patent
Lomasney

(10) Patent No.: US 10,544,510 B2
(45) Date of Patent: Jan. 28, 2020

(54) ELECTRODEPOSITED, NANOLAMINATE COATINGS AND CLADDINGS FOR CORROSION PROTECTION

(71) Applicant: Modumetal, Inc., Seattle, WA (US)

(72) Inventor: Christina A. Lomasney, Seattle, WA (US)

(73) Assignee: MODUMETAL, INC., Seattle, WA (US)

( * ) Notice: Subject to any disclaimer, the term of this patent is extended or adjusted under 35 U.S.C. 154(b) by 511 days.

(21) Appl. No.: 14/729,020

(22) Filed: Jun. 2, 2015

(65) Prior Publication Data

US 2016/0024663 A1 Jan. 28, 2016

Related U.S. Application Data

(60) Division of application No. 13/314,948, filed on Dec. 8, 2011, now Pat. No. 10,253,419, which is a continuation of application No. PCT/US2010/037856, filed on Jun. 8, 2010.

(60) Provisional application No. 61/185,020, filed on Jun. 8, 2009.

(51) Int. Cl.

| | |
|---|---|
| ***C25D 5/10*** | (2006.01) |
| ***C23F 17/00*** | (2006.01) |
| ***C25D 5/14*** | (2006.01) |
| ***C25D 5/18*** | (2006.01) |

(Continued)

(52) U.S. Cl.

CPC ..... *C23F 17/00* (2013.01); *C25D 5/10* (2013.01); *C25D 5/14* (2013.01); *C25D 5/18* (2013.01); *C25D 5/20* (2013.01); *C25D 15/00* (2013.01); *Y10T 428/12493* (2015.01)

(58) Field of Classification Search

None

See application file for complete search history.

(56) References Cited

U.S. PATENT DOCUMENTS

| | | | |
|---|---|---|---|
| 2,428,033 | A | 9/1947 | Nachtman |
| 3,090,733 | A | 5/1963 | Brown |
| 3,255,781 | A | 6/1966 | Gillespie, Jr. |

(Continued)

FOREIGN PATENT DOCUMENTS

| | | | |
|---|---|---|---|
| CN | 1257941 | A | 6/2000 |
| CN | 1380446 | A | 11/2002 |

(Continued)

OTHER PUBLICATIONS

"Improvement of Galvanneal Coating Adherence on Advanced High Strength Steel," Appendix 1: Literature review (Task1), Progress Report No. 1 to Galvanized Autobody Partnership Program of International Zinc Association, Brussels, Belgium, Jun. 2008-Jul. 2009, Issued: Sep. 2009.

(Continued)

*Primary Examiner* — Adam Krupicka

(74) *Attorney, Agent, or Firm* — Seed Intellectual Property Law Group LLP

(57) ABSTRACT

Described herein are electrodeposited corrosion-resistant multilayer coating and claddings that comprises multiple nanoscale layers that periodically vary in electrodeposited species or electrodeposited microstructures. The coatings may comprise electrodeposited metals, ceramics, polymers or combinations thereof. Also described herein are methods for preparation of the coatings and claddings.

16 Claims, 1 Drawing Sheet

(51) Int. Cl.
*C25D 5/20* (2006.01)
*C25D 15/00* (2006.01)

(56) References Cited

U.S. PATENT DOCUMENTS

| | | | | |
|---|---|---|---|---|
| 3,282,810 | A | 11/1966 | Odekerken | |
| 3,362,851 | A | 1/1968 | Dunster | |
| 3,716,464 | A | 2/1973 | Kovac et al. | |
| 3,866,289 | A * | 2/1975 | Brown | C25D 5/12 205/109 |
| 3,996,114 | A | 12/1976 | Ehrsam | |
| 4,191,617 | A | 3/1980 | Hurley et al. | |
| 4,216,272 | A | 8/1980 | Clauss | |
| 4,284,688 | A | 8/1981 | Stücheli et al. | |
| 4,314,893 | A | 2/1982 | Clauss | |
| 4,461,680 | A | 7/1984 | Lashmore | |
| 4,510,209 | A | 4/1985 | Hada et al. | |
| 4,540,472 | A | 9/1985 | Johnson | |
| 4,543,300 | A | 9/1985 | Hara | |
| 4,652,348 | A | 3/1987 | Yahalom et al. | |
| 4,678,552 | A | 7/1987 | Chen | |
| 4,678,721 | A | 7/1987 | den Broeder et al. | |
| 4,869,971 | A | 9/1989 | Nee et al. | |
| 4,885,215 | A | 12/1989 | Yoshioka et al. | |
| 4,904,542 | A | 2/1990 | Mroczkowski | |
| 4,975,337 | A | 12/1990 | Hyner et al. | |
| 5,043,230 | A | 8/1991 | Jagannathan et al. | |
| 5,268,235 | A | 12/1993 | Lashmore et al. | |
| 5,413,874 | A | 5/1995 | Moysan, III et al. | |
| 5,489,488 | A | 2/1996 | Asai et al. | |
| 6,143,424 | A | 11/2000 | Jonte et al. | |
| 6,143,430 | A | 11/2000 | Miyasaka et al. | |
| 6,344,123 | B1 | 2/2002 | Bhatnagar | |
| 6,468,672 | B1 | 10/2002 | Donovan, III et al. | |
| 8,152,985 | B2 | 4/2012 | Macary | |
| 9,005,420 | B2 | 4/2015 | Tomantschger et al. | |
| 9,080,692 | B2 | 7/2015 | Tomomori et al. | |
| 10,253,419 | B2 | 4/2019 | Lomasney | |
| 10,266,957 | B2 | 4/2019 | Sugawara et al. | |
| 2002/0070118 | A1 | 6/2002 | Schreiber et al. | |
| 2003/0234181 | A1 | 12/2003 | Palumbo et al. | |
| 2004/0031691 | A1 | 2/2004 | Kelly et al. | |
| 2004/0211672 | A1 | 10/2004 | Ishigami et al. | |
| 2005/0109433 | A1 | 5/2005 | Danger et al. | |
| 2006/0243597 | A1 | 11/2006 | Matefi-Tempfli et al. | |
| 2006/0272949 | A1 | 12/2006 | Detor et al. | |
| 2009/0130425 | A1 | 5/2009 | Whitaker | |
| 2010/0187117 | A1 | 7/2010 | Lingenfelter et al. | |
| 2010/0304063 | A1 | 12/2010 | McCrea et al. | |
| 2016/0002803 | A1 | 1/2016 | Sklar | |
| 2016/0002806 | A1 | 1/2016 | Lomasney et al. | |
| 2017/0191179 | A1 | 7/2017 | Sklar | |

FOREIGN PATENT DOCUMENTS

| | | | |
|---|---|---|---|
| CN | 1924110 | A | 3/2007 |
| CN | 101113527 | A | 1/2008 |
| CN | 101195924 | A | 6/2008 |
| CN | 102317504 | A | 1/2012 |
| EP | 2 220 270 | A1 | 8/2010 |
| GB | 2 324 813 | A | 11/1998 |
| JP | 58-197292 | A | 11/1983 |
| WO | WO 97/00980 | A1 | 1/1997 |
| WO | 2009/045433 | A1 | 4/2009 |
| WO | WO 2009/079745 | A1 | 7/2009 |
| WO | 2011/033775 | A1 | 3/2011 |

OTHER PUBLICATIONS

Blum, "The Structure and Properties of Alternately Electrodeposited Metals," paper presented at the Fortieth General Meeting of the American Electrochemical Society, Lake Placid, New York, 14 pages. (Oct. 1, 1921).

Communication pursuant to Article 94(3) EPC, European Application No. 10 728 060.4, 6 pages (Mar. 10, 2015).

Communication pursuant to Article 94(3) EPC, European Application No. 10 728 060.4, 8 pages (Mar. 22, 2016).

Huang et al., "Characterization of Cr—Ni multilayers electroplated from a chromium(III)-nickel(II) bath using pulse current," *Scripta Materialia*, 57:61-64 (2007).

International Search Report and Written Opinion dated Feb. 10, 2011, in International Patent Application No. PCT/US2010/037856, 14 pages.

Ivanov et al., "Corrosion resistance of compositionally modulated multilayered Zn—Ni alloys deposited from a single bath," *Journal of Applied Electrochemistry*, 33:239-244 (2003).

Kalu et al., "Cyclic voltammetric studies of the effects of time and temperature on the capacitance of electrochemically deposited nickel hydroxide," *Journal of Power Sources*, 92:163-167 (2001).

Kirilova et al., "Corrosion behaviour of Zn—Co compositionally modulated multilayers electrodeposited from single and dual baths," *Journal of Applied Electrochemistry*, 29:1133-1137 (1999).

Onoda et al., "Preparation of Amorphous/Crystalloid Soft Magnetic Multilayer Ni—Co—B Alloy Films by Electrodeposition," *Journal of Magnetism and Magnetic Materials*, 126(1-3):595-598 (Sep. 1, 1993).

Ross, "Electrodeposited Multilayer Thin Films," *Annual Review of Materials Science*, 24:159-188 (1994).

Rousseau et al., "Single-bath Electrodeposition of Chromium-Nickel Compositionally Modulated Multilayers (CMM) From a Trivalent Chromum Bath," *Plating and Surface Finishing*, pp. 106-110 (Sep. 1999).

Thangaraj et al., "Corrosion Behaviour of Composition Modulated Multilayer Zn—Co Electrodeposits produced Using a Single-Bath Technique," *Journal of Applied Electrochemistry*, 39:339-345 (Oct. 21, 2008).

Thangaraj et al., "Surface Modification by Compositionally Modulated Multilayered Zn—Fe Coatings," *Chinese Journal of Chemistry*, 26:2285-2291 (2008).

Tokarz et al., "Preparation, Structural and Mechanical Properties of Electrodeposited Co/Cu Multilayers," *Physica Status Solidi*, 11:3526-3529 (Jun. 18, 2008).

Weil et al., "Properties of Composite Electrodeposits," Final Report, Contract No. DAALO3-87-K-0047, U.S. Army Research Office, 21 pages (Jan. 1, 1990).

Wilcox, "Surface Modification With Compositionally Modulated Multilayer Coatings," *The Journal of Corrosion Science and Engineering*, 6, Paper 52, 5 pages (submitted Jul. 6, 2003; fully published Jul. 26, 2004).

Designing with Metals—Power Manufacturing, http://www.pwrmfg.com/power-manufacturing/technical-info/designing-with-metals/, printed Oct. 5, 2017 (2017), 3 pages.

Etminanfar et al., "Corrosion resistance of multilayer coatings of nanolayered Cr/Ni electrodeposited from Cr(III)—Ni(II) bath," Thin Solid Films, 520, 5322-5327 (2012).

Georgescu et al., "Magnetic Behavior of [Ni/Co—Ni—Mg—N] x n Cylindrical Multilayers prepared by Magnetoelectrolysis," Phys. Stat. Sol. (a) 189, No. 3, 1051-1055 (2002).

Huang et al., "Hardness variation and annealing behavior of a Cr—Ni multilayer electroplated in a trivalent chromium-based bath," Surface & Coatings Technology, 203, 3320-3324 (2009).

Tench et al., "Considerations in Electrodeposition of Compositionally Modulated Alloys," J. Electrochem. Soc., vol. 137, No. 10, Oct. 1990, 3061-3066.

Srivastava et al., "Corrosion resistance and microstructure of electrodeposited nickel-cobalt alloy coatings," Surface & Coatings Technology, 201, (2006) 3051-3060.

U.S. Appl. No. 16/191,386, filed Nov. 14, 2018.

* cited by examiner

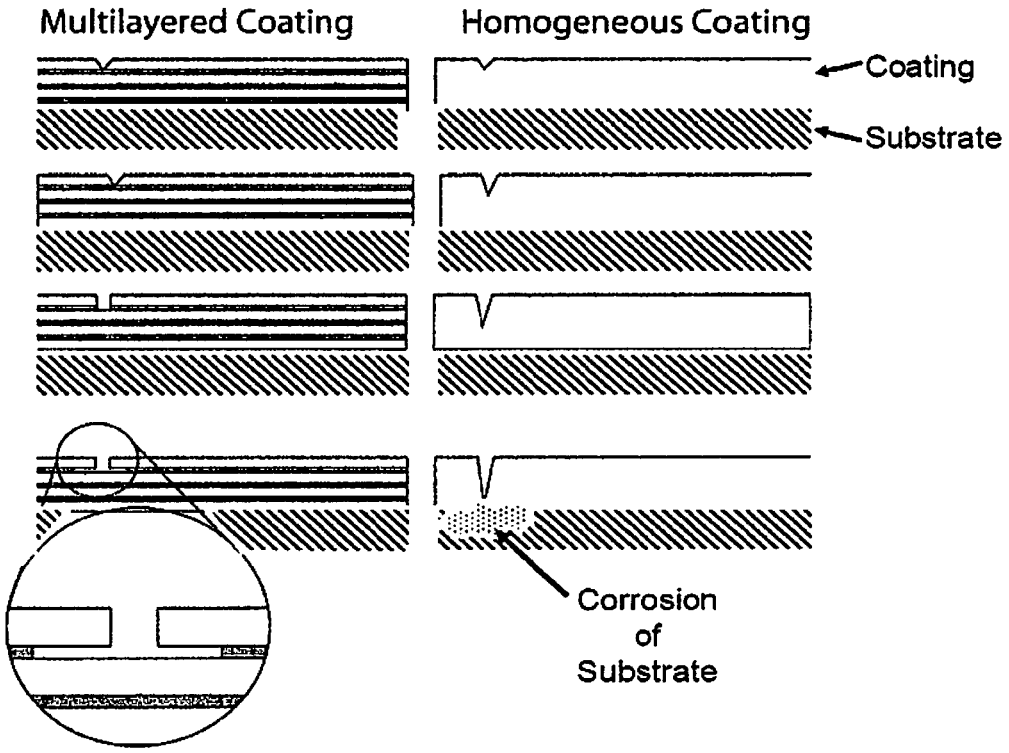
Multilayered Coating
Homogeneous Coating
Coating
Substrate
Corrosion
of
Substrate

ELECTRODEPOSITED, NANOLAMINATE COATINGS AND CLADDINGS FOR CORROSION PROTECTION

This application is a continuation of U.S. application Ser. No. 13/314,948, filed Dec. 8, 2011, which is a continuation of PCT/US2010/037856, filed Jun. 8, 2010, published as WO2010/144509, which claims the benefit of U.S. Provisional Application No. 61/185,020, filed Jun. 8, 2009, each of which application is incorporated herein by reference in its entirety.

BACKGROUND

Laminated metals, and in particular nanolaminated metals, are of interest for structural and thermal applications because of their unique toughness, fatigue resistance and thermal stability. For corrosion protection, however, relatively little success has been reported in the formation of corrosion-resistant coatings that are laminated on the nanoscale.

Electrodeposition has been successfully used to deposit nanolaminated coatings on metal and alloy components for a variety of engineering applications. Electrodeposition is recognized as a low-cost method for forming a dense coating on any conductive substrate. Electrodeposition has been demonstrated as a viable means for producing nanolaminated coatings, in which the individual laminates may vary in the composition of the metal, ceramic or organic-metal composition or other microstructure feature. By time varying electrodeposition parameters such as current density, bath composition, pH, mixing rate, and/or temperature, multi-laminate materials can be produced in a single bath. Alternately by moving a mandrel or substrate from one bath to another, each of which represents a different combination of parameters that are held constant, multi-laminate materials or coatings can be realized.

The corrosion behavior of organic, ceramic, metal and metal-containing coatings depends primarily on their chemistry, microstructure, adhesion, thickness and galvanic interaction with the substrate to which they are applied. In the case of sacrificial metal or metal-containing coatings, such as zinc on an iron-based substrate, the coating is less electronegative than the substrate and so oxidation of the coating occurs preferentially, thus protecting the substrate. Because these coatings protect by providing an oxidation-preferred sacrificial layer, they will continue to work even when marred or scratched. The performance of sacrificial coatings depends heavily on the rate of oxidation of the coating layer and the thickness of the sacrificial layer. Corrosion protection of the substrate only lasts so long as the sacrificial coating is in place and may vary depending on the environment that the coating is subjected to and the resulting rate of coating oxidation.

Alternately, in the case of a barrier coating, such as nickel on an iron-based substrate, the coating is more electronegative than the substrate and thus works by creating a barrier to oxidative corrosion. In A-type metals, such as Fe, Ni, Cr and Zn, it is generally true that the higher the electronegativity, the greater the nobility (non reactivity). When the coating is more noble than the substrate, if that coating is marred or scratched in any way, or if coverage is not complete, these coatings will not work, and may accelerate the progress of substrate corrosion at the substrate: coating interface, resulting in preferential attack of the substrate. This is also true when ceramic coatings are used. For example, it has been reported in the prior art that while fully dense TiN coatings are more noble than steel and aluminum in resistance to various corrosive environments, pinholes and micropores that can occur during processing of these coating are detrimental to their corrosion resistance properties. In the case of barrier coatings, pinholes in the coating may accelerate corrosion in the underlying metal by pitting, crevice or galvanic corrosion mechanisms.

Many approaches have been utilized to improve the corrosion resistance of barrier coatings, such as reducing pinhole defects through the use of a metallic intermediate layer or multiple layering schemes. Such approaches are generally targeted at reducing the probability of defects or reducing the susceptibility to failure in the case of a defect, mar or scratch. One example of a multiple layering scheme is the practice commonly found in the deployment of industrial coatings, which involves the use of a primer, containing a sacrificial metal such as zinc, coupled with a highly-crosslinked, low surface energy topcoat (such as a fluorinated or polyurethane topcoat). In such case, the topcoat acts as a barrier to corrosion. In case the integrity of the topcoat is compromised for any reason, the metal contained in the primer acts as a sacrificial media, thus sacrificially protecting the substrate from corrosion.

Dezincification is a term is used to mean the corroding away of one constituent of any alloy leaving the others more or less in situ. This phenomenon is perhaps most common in brasses containing high percentages of zinc, but the same or parallel phenomena are familiar in the corrosion of aluminum bronzes and other alloys of metals of widely different chemical affinities. Dezincification usually becomes evident as an area with well-defined boundaries, and within which the more noble metal becomes concentrated as compared with the original alloy. In the case of brass the zinc is often almost completely removed and copper is present almost in a pure state, but in a very weak mechanical condition. Corrosion by dezincification usually depends on the galvanic differential between the dissimilar metals and the environmental conditions contributing to corrosion. Dezincification of alloys results in overall loss of the structural integrity of the alloy and is considered one of the most aggressive forms of corrosion.

Coatings that may represent the best of both the sacrificial coating and the barrier coating are those that are more noble than the substrate and creates a barrier to corrosion, but, in case that coating is compromised, is also less noble than the substrate and will sacrificially corrode, thus protecting the substrate from direct attack.

SUMMARY OF THE INVENTION

In one embodiment of the technology described herein, the phenomena observed in dezincification of alloys is leveraged to enable corrosion resistant coatings that are both more and less noble than the substrate, and which protect the substrate by acting both as a barrier and as a sacrificial coating. Other embodiments and advantages of this technology will become apparent upon consideration of the following description.

The technology described herein includes in one embodiment an electrodeposited, corrosion-resistant multilayer coating or cladding, which comprises multiple nanoscale layers that periodically vary in electrodeposited species or electrodeposited microstructures (electrodeposited species microstructures), wherein variations in said layers of said electrodeposited species or electrodeposited species microstructure result in galvanic interactions between the layers, said nanoscale layers having interfaces there between.

The technology described herein also provides an electrodeposition method for producing a corrosion resistant multilayer coating or cladding comprising the steps of:

a) placing a mandrel or a substrate to be coated in a first electrolyte containing one or more metal ions, ceramic particles, polymer particles, or a combination thereof; and b) applying electric current and varying in time one or more of: the amplitude of the electrical current, electrolyte temperature, electrolyte additive concentration, or electrolyte agitation, in order to produce periodic layers of electrodeposited species or periodic layer of electrodeposited species microstructures; and c) growing a multilayer coating under such conditions until the desired thickness of the multilayer coating is achieved.

Such a method may further comprising after step (c), step (d), which comprises removing the mandrel or the substrate from the bath and rinsing.

The technology described herein further provides an electrodeposition method for producing a corrosion resistant multilayer coating or cladding comprising the steps of:

a) placing a mandrel or substrate to be coated in a first electrolyte containing one or more metal ions, ceramic particles, polymer particles, or a combination thereof; and b) applying electric current and varying in time one or more of: the electrical current, electrolyte temperature, electrolyte additive concentration, or electrolyte agitation, in order to produce periodic layers of electrodeposited species or periodic layer of electrodeposited species microstructures; and c) growing a nanometer-thickness layer under such conditions; and d) placing said mandrel or substrate to be coated in a second electrolyte containing one or more metal ions that is different from said first electrolyte, said second electrolyte containing metal ions, ceramic particles, polymer particles, or a combination thereof; and e) repeating steps (a) through (d) until the desired thickness of the multilayer coating is achieved;

wherein steps (a) through (d) are repeated at least two times. Such a method may further comprising after step (e), step (f) which comprises removing the mandrel or the coated substrate from the bath and rinsing.

Also described herein is an electrodeposited, corrosion-resistant multilayer coating or cladding, which comprises multiple nanoscale layers that vary in electrodeposited species microstructure, which layer variations result in galvanic interactions occurring between the layers. Also described is a corrosion-resistant multilayer coating or cladding, which comprises multiple nanoscale layers that vary in electrodeposited species, which layer variations result in galvanic interactions occurring between the layers.

The coating and claddings described herein are resistant to corrosion due to oxidation, reduction, stress, dissolution, dezincification, acid, base, or sulfidation and the like.

BRIEF DESCRIPTION OF THE DRAWINGS

FIG. 1 shows a schematic of a substrate having the "Multilayered Coating" of a preferred embodiment (on the left of FIG. 1) and a schematic of a substrate having a "Homogeneous Coating" as is known in the art (on the right of FIG. 1). Both the left and right side schematics represent how a pinhole, a micropore or damage to a coating changes over time (in sequence from the top to the bottom of FIG. 1) relative to the substrate shown on the bottom of each of the sequences. The schematic illustrates a few representative layers that are not to scale with the substrate. In typical embodiments coating layers are on the nanoscale and present in a greater number than shown in FIG. 1.

DETAILED DESCRIPTION

In one embodiment an electrodeposited corrosion-resistant multilayer coating comprised of individual layers with thicknesses on the nanometer scale is provided. In such an embodiment the individual layers can differ in electronegativity from adjacent layers.

In other embodiments, the present technology provides corrosion-resistant multilayer coatings or claddings (together herein referred to as a "coating") that comprise multiple nanoscale layers having variations in the composition of metal, alloy, polymer, or ceramic components, or combination thereof (together herein referred to as "electrodeposited species").

In such embodiments the variations in the compositions between layers results in galvanic interactions occurring between the layers.

In another embodiment, the present technology provides a corrosion-resistant multilayer coating that comprises multiple nanoscale layers having layer variations in grain size, crystal orientation, grain boundary geometry, or combination thereof (together herein referred to as "electrodeposited species microstructure(s)"), which layer variations result in galvanic interactions occurring between the layers.

In another embodiment multilayer coating or cladding is provided for, in which the layers vary in electronegativity or in nobility, and in which the rate of corrosion can be controlled by controlling the difference in electronegativity or in the reactivity (or "nobility") of adjacent layers.

One embodiment of the present technology provides a multilayer coating or cladding in which one of the periodic layers is less noble than the other layer and is less noble than the substrate, thus establishing a periodic sacrificial layer in the multilayer coating.

As used herein "layers that periodically vary" means a series of two or more non-identical layers (non identical "periodic layers") that are repeatedly applied over an underlying surface or mandrel. The series of non-identical layers can include a simple alternating pattern of two or more non-identical layers (e.g., layer 1, layer 2, layer 1, layer 2, etc.) or in another embodiment may include three or more non-identical layers (e.g., layer 1, layer 2, layer 3, layer 1, layer 2, layer 3, etc.). More complex alternating patterns can involve two, three, four, five or more layers arranged in constant or varying sequences (e.g., layer 1, layer 2, layer 3, layer 2, layer 1, layer 2, layer 3, layer 2, layer 1, etc.). In one embodiment, a series of two layers is alternately applied 100 times to provide a total of 200 layers having 100 periodic layers of a first type alternated with 100 periodic layers of a second type, wherein the first and second type of periodic layer are not identical. In other embodiments, "layers that periodically vary" include 2 or more, 3 or more, 4 or more, or 5 or more layers that are repeatedly applied about 5, 10, 20, 50, 100, 200, 250, 500, 750, 1,000, 1,250, 1,500, 1,750, 2,000, 3,000, 4,000, 5,000, 7,500, 10,000, 15,000, 20,000 or more times.

As used herein, a "periodic layer" is an individual layer within "layers that periodically vary".

In another embodiment, the present technology provides a multilayer coating or cladding in which one of the periodic layers is more noble than the other layer and is more noble than the substrate, thus establishing a periodic corrosion barrier layer in the multilayer coating.

In another embodiment, the present technology provides a multilayer coating in which one of the periodic layers is less noble than the adjacent layers and all layers are less noble than the substrate.

In still another embodiment, the present technology provides a multilayer coating or cladding in which one of the periodic layers is more noble than the adjacent layers and all layers are more noble than the substrate.

One embodiment of the present technology provides for a corrosion-resistant multilayer coating or cladding compositions that comprise individual layers, where the layers are not discrete, but rather exhibit diffuse interfaces with adjacent layers. In some embodiments the diffuse region between layers may be 0.5, 0.7, 1, 2, 5, 10, 15, 20, 25, 30, 40, 50 75, 100, 200, 400, 500, 1,000, 2,000, 4,000, 6,000, 8,000 or 10,000 nanometers. In other embodiments the diffuse region between layers may be 1 to 5, or 5 to 25, or 25 to 100, or 100 to 500, or 500 to 1,000, or 1,000 to 2,000, or 2,000 to 5,000, or 4,000 to 10,000 nanometers. The thickness of the diffuse interface may be controlled in a variety of ways, including the rate at which the electrodeposition conditions are change.

Another embodiment of the technology described herein provides a method for producing a multilayered corrosion-resistant coating that comprises multiple nanoscale layers ("nanolaminates") that vary in electrodeposited species or electrodeposited species microstructure or a combination thereof, which layers are produced by an electrodeposition process.

Where variations in electrodeposited species or combinations thereof are employed, in some embodiments, the electrodeposited species may comprise one or more of Ni, Zn, Fe, Cu, Au, Ag, Pd, Sn, Mn, Co, Pb, Al, Ti, Mg and Cr, $Al_2O_3$, $SiO_2$, TiN, BoN, $Fe_2O_3$, MgO, and $TiO_2$, epoxy, polyurethane, polyaniline, polyethylene, poly ether ether ketone, polypropylene.

In other embodiments the electrodeposited species may comprise one or more metals selected from Ni, Zn, Fe, Cu, Au, Ag, Pd, Sn, Mn, Co, Pb, Al, Ti, Mg and Cr. Alternatively, the metals may be selected from: Ni, Zn, Fe, Cu, Sn, Mn, Co, Pb, Al, Ti, Mg and Cr; or from Ni, Zn, Fe, Cu, Sn, Mn, Co, Ti, Mg and Cr; or from Ni, Zn, Fe, Sn, and Cr. The metal may be present in any percentage. In such embodiments the percentage of each metal may independently selected about 0.001, 0.005, 0.01, 0.05, 0.1, 0.5, 1, 5, 10, 15, 20, 25, 30, 30, 35, 40, 45, 50, 55, 60, 65, 70, 75, 80, 85, 90, 95, 98, 99, 99.9, 99.99, 99.999 or 100 percent of the electrodeposited species. Unless otherwise indicated, the percentages provided herein refer to weight percentages.

In other embodiments the electrodeposited species may comprise one or more ceramics (e.g., metals oxides or metal nitrides) selected from $Al_2O_3$, $SiO_2$, TiN, BoN, $Fe_2O_3$, MgO, SiC, ZrC, CrC, diamond particulates, and $TiO_2$. In such embodiments the percentage of each ceramic may independently selected about 0.001, 0.005, 0.01, 0.05, 0.1, 0.5, 1, 5, 10, 15, 20, 25, 30, 30, 35, 40, 45, 50, 55, 60, 65, 70, 75, 80, 85, 90, 95, 98, 99, 99.9, 99.99, 99.999 or 100 percent of the electrodeposited species.

In still other embodiments the electrodeposited species may comprise one or more polymers selected from epoxy, polyurethane, polyaniline, polyethylene, poly ether ether ketone, polypropylene, and poly(3,4-ethylenedioxythiophene) poly(styrenesulfonate). In such embodiments the percentage of each polymer may independently selected about 0.001, 0.005, 0.01, 0.05, 0.1, 0.5, 1, 5, 10, 15, 20, 25, 30, 30, 35, 40, 45, 50, 55, 60, 65, 70, 75, 80, 85, 90, 95, 98, 99, 99.9, 99.99, 99.999 or 100 percent of the electrodeposited species.

Another embodiment of the present technology provides a electrodeposition method for producing a nanolaminated, corrosion resistant coating which reduces through-hole defects in the overall corrosion resistant coating. Such methods include those wherein multi-layered coatings or claddings are applied to a substrate or mandrel as illustrated in FIG. 1.

As shown on the left of FIG. 1, the multilayer coating of a preferred embodiment is disposed to have two alternating (light and dark) layers covering a substrate. In the embodiment of the left side of FIG. 1, the light layer is a protective layer and the dark layer is a sacrificial layer. As the sequence shows, over time the hole in the light layer expands slightly in a direction parallel to the surface of the substrate, and the sacrificial dark layer under the damaged light layer is consumed in a direction parallel with the surface of the substrate. It is also noted that the hole in the outermost (exposed) layer of the multilayer coating does not expand to breach the second light layer disposed between the hole and the substrate, thereby protecting the substrate from corrosion. In a preferred embodiment, corrosion is confined to the less-noble layers (the dark layers), with the layers being protected cathodically and the corrosion proceeding laterally rather than towards the substrate.

As shown on the right of FIG. 1, the homogeneous coating of the prior art is disposed to have a single layer covering a substrate. As the sequence shows, over time the hole in the single layer expands in a direction normal to the surface of the substrate until ultimately reaching the substrate, which thereafter is affected by corrosion or other forms of degradation.

In one embodiment, the technology described herein describes a method for producing a multilayer, nanolaminated coating by an electrodeposition process carried out in a single bath, comprising the steps of:

a) placing a mandrel or a substrate to be coated in a first electrolyte containing one or more metal ions, ceramic particles, polymer particles, or a combination thereof; and b) applying electric current and varying in time one or more of: the amplitude of the electrical current, electrolyte temperature, electrolyte additive concentration, or electrolyte agitation, in order to produce periodic layers of electrodeposited species or periodic layer of electrodeposited species microstructures; and c) growing a multilayer coating under such conditions until the desired thickness of the multilayer coating is achieved.

Such a method may further comprise after step (c), step (d) removing the mandrel or the substrate from the bath and rinsing.

The technology described herein also sets forth a method for producing a multilayer, nanolaminated coating or cladding using serial electrodeposition in two or more baths comprising the steps of:

a) placing a mandrel or substrate to be coated in a first electrolyte containing one or more metal ions, ceramic particles, polymer particles, or a combination thereof; and b) applying electric current and varying in time one or more of: the electrical current, electrolyte temperature, electrolyte additive concentration, or electrolyte agitation, in order to produce periodic layers of electrodeposited species or periodic layer of electrodeposited species microstructures; and c) growing a nanometer-thickness layer under such conditions; and d) placing said mandrel or substrate to be coated in a second electrolyte containing one or more metal ions that is different from said first electrolyte, said second electrolyte containing metal ions, ceramic particles, polymer particles, or a combination thereof; and e) repeating steps (a) through (d) until the desired thickness of the multilayer coating is achieved; wherein steps (a) through (d) are repeated at least two times.

Such a method may further comprise after step (e), step (f) removing the mandrel or the coated substrate from the bath and rinsing.

Corrosion-resistant multilayer coatings can be produced on a mandrel, instead of directly on a substrate to make a free-standing material or cladding. Cladding produced in this manner may be attached to the substrate by other means, including welding, gluing or through the use of other adhesive materials.

The multilayer coatings can comprise layers of metals that are electrolytically deposited from aqueous solution, such as Ni, Zn, Fe, Cu, Au, Ag, Pd, Sn, Mn, Co, Pb and Cr. The multilayer coating can also comprise alloys of these metals, including, but not limited to: ZnFe, ZnCu, ZnCo, NiZn, NiMn, NiFe, NiCo, NiFeCo, CoFe, CoMn. The multilayer can also comprise metals that are electrolytically deposited from a molten salt or ionic liquid solution. These include those metals previously listed, and others, including, but not limited to Al, Mg, Ti and Na. In other embodiments multilayer coatings can comprise one or more metals selected from Ni, Zn, Fe, Cu, Au, Ag, Pd, Sn, Mn, Co, Pb, Al, Ti, Mg and Cr. Alternatively, one or more metals to be electrolytically deposited may be selected from: Ni, Zn, Fe, Cu, Sn, Mn, Co, Pb, Al, Ti, Mg and Cr; or from Ni, Zn, Fe, Cu, Sn, Mn, Co, Ti, Mg and Cr; or from Ni, Zn, Fe, Sn, and Cr.

The multilayer coating can comprise ceramics and polymers that are electrophoretically deposited for aqueous or ionic liquid solutions, including, but not limited to $Al_2O_3$, $SiO_2$, TiN, BoN, $Fe_2O_3$, MgO, and $TiO_2$. Suitable polymers include, but are not limited to, epoxy, polyurethane, polyaniline, polyethylene, poly ether ether ketone, polypropylene.

The multilayer coating can also comprise combinations of metals and ceramics, metals and polymers, such as the above-mentioned metals, ceramics and polymers.

The thickness of the individual layers (nanoscale layers) can vary greatly as for example between 0.5 and 10,000 nanometers, and in some embodiments is about 200 nanometers per layer. The thickness of the individual layers (nanoscale layers) may also be about 0.5, 0.7, 1, 2, 5, 10, 15, 20, 25, 30, 40, 50 75, 100, 200, 400, 500, 1,000, 2,000, 4,000, 6,000, 8,000 or 10,000 nanometers. In other embodiments the layers may be about 0.5 to 1, or 1 to 5, or 5 to 25, or 25 to 100, or 100 to 300, or 100 to 400, or 500 to 1,000, or 1,000 to 2,000, or 2,000 to 5,000, or 4,000 to 10,000 nanometers.

Individual layers may be of the same thickness or different thickness. Layers that vary periodically may also vary in thickness.

The overall thickness of the coating or cladding can vary greatly as, for example, between 2 micron and 6.5 millimeters or more. In some embodiments the overall thickness of the coating or cladding can also be between 2 nanometers and 10,000 nanometers, 4 nanometers and 400 nanometers, 50 nanometers and 500 nanometers, 100 nanometers and 1,000 nanometers, 1 micron to 10 microns, 5 microns to 50 microns, 20 microns to 200 microns, 200 microns to 2 millimeters (mm), 400 microns to 4 mm, 200 microns to 5 mm, 1 mm to 6.5 mm, 5 mm to 12.5 mm, 10 mm to 20 mm, 15 mm to 30 mm.

Layer thickness can be controlled by, among other things, the application of current in the electrodeposition process. This technique involves the application of current to the substrate or mandrel to cause the formation of the coating or cladding on the substrate or mandrel. The current can be applied continuously or, more preferably, according to a predetermined pattern such as a waveform. In particular, the waveform (e.g., sine waves, square waves, sawtooth waves, or triangle waves). can be applied intermittently to promote the electrodeposition process, to intermittently reverse the electrodeposition process, to increase or decrease the rate of deposition, to alter the composition of the material being deposited, or to provide for a combination of such techniques to achieve a specific layer thickness or a specific pattern of differing layers. The current density and the period of the wave forms may be varied independently. In some embodiments current density may be continuously or discretely varied with the range between 0.5 and 2000 $mA/cm^2$. Other ranges for current densities are also possible, for example, a current density may be varied within the range between: about 1 and 20 $mA/cm^2$; about 5 and 50 $mA/cm^2$; about 30 and 70 $mA/cm^2$; 0.5 and 500 $mA/cm^2$; 100 and 2000 $mA/cm^2$; greater than about 500 $mA/cm^2$; and about 15 and 40 $mA/cm^2$ base on the surface area of the substrate or mandrel to be coated. In some embodiments the frequency of the wave forms may be from about 0.01 Hz to about 50 Hz. In other embodiments the frequency can be from: about 0.5 to about 10 Hz; 0.02 to about 1Hz or from about 2 to 20Hz; or from about 1 to about 5 Hz.

The multilayer coatings and claddings described herein are suitable for coating or cladding a variety of substrates that are susceptible to corrosion. In one embodiment the substrates are particularly suited for coating substrates made of materials that can corrode such as iron, steel, aluminum, nickel, cobalt, iron, manganese, copper, titanium, alloys thereof, reinforced composites and the like.

The coatings and claddings described herein may be employed to protect against numerous types of corrosion, including, but not limited to corrosion caused by oxidation, reduction. stress (stress corrosion), dissolution, dezincification, acid, base, sulfidation and the like.

EXAMPLE #1

Preparation of a multilayer coating comprising nanoscale layers of zinc-iron alloy, in which the concentration of iron varies in adjacent layers.

A zinc-iron bath is produced using a commercial plating bath formula supplied by MacDermid Inc. (Waterbury, Conn.). The composition of the bath is described in Table 1.

TABLE 1

Example Plating Bath

| MacDermid Material | Composition | Product # |
|---|---|---|
| Zinc Metal | 10-12 g/l | 118326 |
| NaOH | 125-135 g/l | |
| Enviralloy Carrier | 0.5-0.6% | 174384 |
| Enviralloy Brightener | 0-0.1% | 174383 |
| Enviralloy Fe | 0.2-0.4% | 174385 |
| Enviralloy C | 4-6% | 174386 |
| Enviralloy B | 0.4-0.6% | 174399 |
| Enviralloy Stabilizer | 0.1-0.2% | 174387 |
| Envirowetter | 0.05-0.2% | 174371 |

A steel panel is immersed into the bath and connected to a power supply. The power supply was combined with a computer generated waveform supply that provided a square waveform which alternates between 25 mA/cm$^2$ (for 17.14 seconds) and 15 mA/cm$^2$ (for 9.52 seconds). The total plating time for a M90 coating (0.9 oz of coating per square foot) is about 1.2 hrs. In this time approximately 325 layers were deposited to achieve a total thickness of 19 μm. The individual layer thickness was between 50 and 100 nm.

The coating is tested in a corrosive environment, in accordance with ASTM B117 (Standard Practice for Operating Salt Spray), and shows no evidence of red rust after 300 hours of exposure.

EXAMPLE #2

Nickel Cobalt alloys have been used extensively in recent history because of its great wear and corrosion resistance. A nanolaminated Ni—Co alloy was created which contains codeposited diamond particles. The Ni—Co alloy by itself is a corrosion and wear resistant alloy. By modulating the electrode potential in the cell, it was possible to laminate the composition of the alloy. By doing this, a galvanic potential difference was established between the layers and thus created a more favorable situation for corrosion and fatigue wear. Also, two unique phases in the crystal structure of the matrix were established. The deposition rate of the diamonds has also been shown to vary with the current density of the cell.

Preparation of a multilayer coating comprising nanoscale layers of a Nickel-Cobalt alloy with diamond codeposition, in which the concentration of the metals vary in adjacent layers.

A traditional Nickel watts bath is used as the basis for the bath. The following table describes all of the components of the bath.

TABLE 2

Example Plating Bath

| Component | Concentration |
|---|---|
| Nickel Sulfate | 250 g/l |
| Nickel Chloride | 30 g/l |
| Boric Acid | 40 g/l |
| Cobalt Chloride | 10 g/l |
| SDS | .01 g/l |
| Diamond (<1 micron size) | 5 g/l |

For creating samples, a steel panel is immersed into the bath and is connected to a power supply. The current density modulation was carried out between 10 mA/cm$^2$ and 35 mA/cm$^2$ with computer controlled software to form nanoscale layers. The current is applied and varied until a 20 μm thick coating had been formed on the substrate surface.

Testing for this coating has been carried out in a salf fog chamber in accordance with the ASTM B117 standers as well as taber wear tests which show the abrasion resistance to be significantly better than homogeneous coatings of Nickel-Cobalt and of stainless steel 316.

EXAMPLE #3

Preparation of a Ni—Zr—Cr alloy system containing particulate precursors.

TABLE 3

Bath Make-up

| Chemical | Conc. (g/L) |
|---|---|
| Nickel Sulfate | 312 |
| Nickel Chloride | 45 |
| Boric Acid | 38 |
| Surfactant (C-TAB ®) | 0.1 |

TABLE 4

Particle Additions

| Particle | Conc. (g/L) |
|---|---|
| Zirconium (1-3 microns) | 40 |
| CrC (1-5 microns) | 15 |

Bath Make-up Procedure:

1. Mix metal salts, boric acid and C-Tab at 100° F.
2. Allow full dissolution, then shift pH to between 5 and 6 with ammonium hydroxide
3. Add particles and allow full mixing
4. Particles should be allowed to mix for one day before plating to allow full surfactant coverage Plating Procedure:

1. Substrates should be prepared in accordance with ASTM standards
2. Electrolyte should be held between 100° F. and 120° F.
3. Solution should have sufficient agitation to prevent particle settling, and fluid flow should be even across the substrate
4. A 50% duty cycle pulse waveform at 75 mA/cm$^2$ effective current density is applied; the average current density of the pulse waveform can be varied and will vary particle inclusion allowing for a laminated structure with controllable deposit composition.

In a first SEM image of the plated substrates shows a high density particle incorporation of zirconium and chromium carbide particles on a steel substrate. Particle spacing is between <1 and 5 microns and the deposit is fully dense. Particles show relatively even distribution throughout the deposit. A second SEM image shows low particle density inclusions on a steel substrate. Particle spacing is between 1 and 15 microns, with some deposit cleaving at particle/matrix interface. Even particle distribution is less pronounced in the second SEM image. Minor surface roughness is seen in both deposits.

Optional Heat Treatment:

In the event the coating requires greater corrosion resistance, a heat treatment can be applied to diffuse included zirconium throughout the deposit, creating, in this case, corrosion-resistant intermetallic phases of the Ni Cr and Zr. Heat treatment may be performed by:

1. Clean the part and dry;
2. Using a furnace of any atmosphere, heat the deposit at no more than 10° C./min up to 927° C.
3. Hold at 927° C. for 2 hours and
4. Air cooling the part.

The above descriptions of exemplary embodiments of methods for forming nanolaminate structures are illustrative of the present invention. Because of variations which will be apparent to those skilled in the art, however, the present invention is not intended to be limited to the particular embodiments described above. The scope of the invention is defined in the following claims.

What is claimed is:

1. A coating or cladding comprising:

a series of alternating layers on a substrate or mandrel, each layer of the series of alternating layers having a thickness from about 5 nanometers to about 1,000 nanometers, the series of alternating layers being arranged in a repeating pattern and comprising:

A) a first metal layer of a first alloy that is more noble than the substrate or the mandrel, the first alloy comprising:

i) Co in a first concentration that is at least about 1 wt. %; and ii) Ni in a second concentration that is at least about 1 wt. %;

B) a second metal layer of a second alloy that is more noble than the first alloy and more noble than the substrate or the mandrel, the second alloy comprising:

i) Co in a third concentration that is at least about 1 wt. %; and ii) Ni in a fourth concentration that is at least about 1 wt. %; and C) a third metal layer of a third alloy that is more noble than the substrate or the mandrel, the third alloy comprising:

i) Co in a fifth concentration that is at least about 1 wt. %; and ii) Ni in a sixth concentration that is at least about 1 wt. %;

the first, second, and third alloys being different, and the coating or cladding having a thickness from 5 microns to 50 microns.

2. The coating or cladding of claim 1, wherein each layer of the series of alternating layers is discrete.

3. The coating or cladding of claim 1, further comprising a diffuse interface between each layer of the series of alternating layers.

4. The coating or cladding of claim 1, wherein the series of alternating layers further comprises a fourth layer of a fourth alloy that is different from the first, second, and third alloys.

5. The coating or cladding of claim 1, wherein the first concentration and the third concentration are independently at least about 5 wt. %.

6. The coating or cladding of claim 1, wherein the second concentration and the fourth concentration are independently at least about 5 wt. %.

7. The coating or cladding of claim 1, wherein the first concentration, the second concentration, the third concentration, and the fourth concentration are independently at least about 5 wt. %.

8. The coating or cladding of claim 1, wherein the first concentration, the second concentration, the third concentration, and the fourth concentration are independently at least about 10 wt. %.

9. The coating or cladding of claim 1, wherein the series of alternating layers does not include ceramic particles.

10. A coating or cladding comprising:

a series of alternating layers on a substrate or mandrel, each layer of the series of alternating layers having a thickness from about 5 nanometers to about 1,000 nanometers, the series of alternating layers being arranged in a repeating pattern and comprising:

A) a first metal layer of a first alloy that is less reactive than the substrate or the mandrel, the first alloy comprising:

i) Co in a first concentration that is at least about 1 wt. %; and ii) Ni in a second concentration that is at least about 1 wt. %;

B) a second metal layer of a second alloy that is less reactive than the substrate or the mandrel, the second alloy being different from the first alloy and comprising:

i) Co in a third concentration that is at least about 1 wt. %; and ii) Ni in a fourth concentration that is at least about 1 wt. %; and C) a third metal layer of a third alloy that is less reactive than the substrate or the mandrel, the third alloy being different from the first and second alloys and comprising:

i) Co in a fifth concentration that is at least about 1 wt. % and ii) Ni in a sixth concentration that is at least about 1 wt. %;

the coating or cladding having a thickness from 5 microns to 50 microns.

11. The coating or cladding of claim 10, wherein each layer of the series of alternating layers is discrete.

12. The coating or cladding of claim 10, further comprising a diffuse interface between each layer of the series of alternating layers.

13. The coating or cladding of claim 10, wherein the series of alternating layers further comprises a fourth layer of a fourth alloy that is different from the first, second, and third alloys.

14. The coating or cladding of claim 10, wherein the first concentration, the second concentration, the third concentration, and the fourth concentration are independently at least about 5 wt. %.

15. The coating or cladding of claim 10, wherein the first concentration, the second concentration, the third concentration, and the fourth concentration are independently at least about 10 wt. %.

16. The coating or cladding of claim 10, wherein the series of alternating layers does not include ceramic particles.

* * * * *